United States Patent [19]

Keller

[11] 4,260,372

[45] Apr. 7, 1981

[54] ROTARY TUBE

[75] Inventor: Wolfgang Keller, Bergisch-Gladbach, Fed. Rep. of Germany

[73] Assignee: Bayer Aktiengesellschaft, Leverkusen, Fed. Rep. of Germany

[21] Appl. No.: 132,947

[22] Filed: Mar. 24, 1980

[30] Foreign Application Priority Data

Apr. 12, 1979 [DE] Fed. Rep. of Germany ..... 2914965

[51] Int. Cl.[3] ..... F27B 7/00

[52] U.S. Cl. ..... 432/103; 432/107; 432/112; 34/134

[58] Field of Search ..... 432/103, 105, 107, 112, 432/113, 114, 117, 118; 34/134, 142

[56] References Cited

U.S. PATENT DOCUMENTS

| | | | |
|---|---|---|---|
| 712,258 | 10/1902 | Campbell | 432/112 |
| 740,607 | 10/1903 | Turney | 34/134 |
| 1,139,663 | 5/1915 | Geiger | 34/134 |
| 1,477,823 | 12/1923 | Grindle | 432/107 |
| 3,294,384 | 12/1966 | Hollefriend | 432/107 |
| 3,852,892 | 12/1974 | Sheehan | 34/134 |
| 3,975,002 | 8/1976 | Mendenhall | 432/112 |
| 4,146,975 | 4/1979 | Duhem | 432/107 |

*Primary Examiner*—Henry C. Yuen

*Attorney, Agent, or Firm*—Sprung, Felfe, Horn, Lynch & Kramer

[57] ABSTRACT

In rotary tubes (1), an insert (4) which expands under the influence of heat can be moved in the radical direction in a cold outer casing (3) by means of an end plate (19) but is fixed in the axial direction, whereas other plates (20, 21) of the insert (4) have cogs (27) which are guided in sliding grooves (16) parallel to the axis due to the thermal expansion, each plate (20, 21) being provided with at least three cogs (24) and three sliding grooves (16) over its periphery.

5 Claims, 4 Drawing Figures

ROTARY TUBE

BACKGROUND OF THE INVENTION

The invention relates to a rotary tube with an outer casing and at least one treatment tube in which can be arranged a heat supply, which is held in end plates and optionally in intermediate plates, these plates being supported in the outer casing.

During the thermal treatment of solids in indirectly heated rotary tubes, problems concerning the permissible stresses arise a treatment tube wall temperatures exceeding 450°. Even with heat-resistant materials, the length of the rotary tube is restricted to a few metres, for example at temperatures of about 1000° C, if no expensive intermediate bearings are provided.

With long treatment tubes which are to be heated, the problem arises of compensating for the thermal expansion relative to the colder outer casing which expands less. The same problem also arises with short treatment tubes which are heated to high temperatures. In both cases, the radial thermal expansion can give rise to problems.

SUMMARY OF THE INVENTION

An object to be achieved is to find a rotary tube with which the thermal expansion between the heated treatment tube and the colder outer casing can be compensated so as to avoid stress.

This object is achieved in that one of then plates is fixed in the axial direction but is movable in the radial direction and that at least n-1 plates each have at least three cogs pointing in a radial direction which engage in associated sliding grooves provided in the outer casing and extending parallel to the axis, these sliding grooves being sufficiently long and deep to accommodate the shifting of the cogs in the various directions due to the thermal expansion of the treatment tube. It goes without saying that, as an alternative, the cogs are provided on the outer casing and the sliding grooves on the plates.

This allows the insert consisting of one or more treatment tubes mounted in end plate and optionally intermediate plates to expand freely both in the axial direction of the rotary tube and in the radial direction under the influence of heat but nevertheless to be mounted sufficiently and without stress in the outer casing.

During the rotation of the rotary tube, the contacting surfaces of the cogs and sliding grooves are loaded periodically up to a maximum value during a revolution and also completely relaxed again. The edge of the fixed plate engages in an annular groove in the outer casing lying in a plane perpendicular to the longitudinal axis of the tube. The groove must be deep enough to accommodate the radial thermal expansion of the plate. The width of the groove should be selected in such a way that the plate is not clamped under the operating conditions. The axially parallel arrangement of the other sliding grooves allows the lengthwise shifting of the engaging cogs as well as their expansion in the radial direction. The insert consisting of the treatment tube and the plates is not therefore supported by the ends of the cogs but by their sides resting on the walls of the sliding grooves, during a rotation. Each cog is completely unstressed in its vertical position, i.e. in the lower and upper position, but its load increases continuously to a maximum toward the horizontal position. The design according to the invention allows a plurality of intermediate plates to be used, thus allowing a reduction in the thickness of the treatment tube wall so that better and faster heat transfer takes place during indirect heating and less-expensive material can be used. No problems arise even if a plurality of tubes is provided instead of a single treatment tube. The tubes are generally fastened to the fixed plate but they can additionally be fastened to the other plates. Due to the high surface pressure, the cogs are preferably designed as runners or sliding blocks, in which case, however, the side faces represent the sliding faces. Accordingly, the high loading of the side faces must be taken into consideration in the selection of material for the cogs and the sliding grooves.

An embodiment of a rotary tube according to the invention is illustrative purely schematically in the drawings and is described in more detail below.

DETAILED DESCRIPTION OF THE INVENTION

Figure 1:
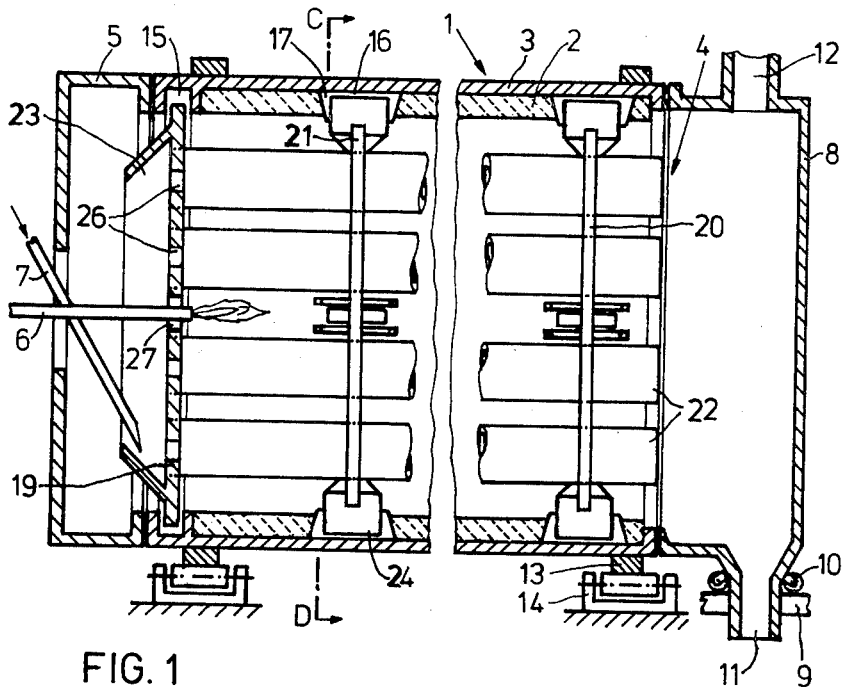
FIG. 1 shows the rotary tube on a section along line A—B in FIG. 2.
Figure 2:
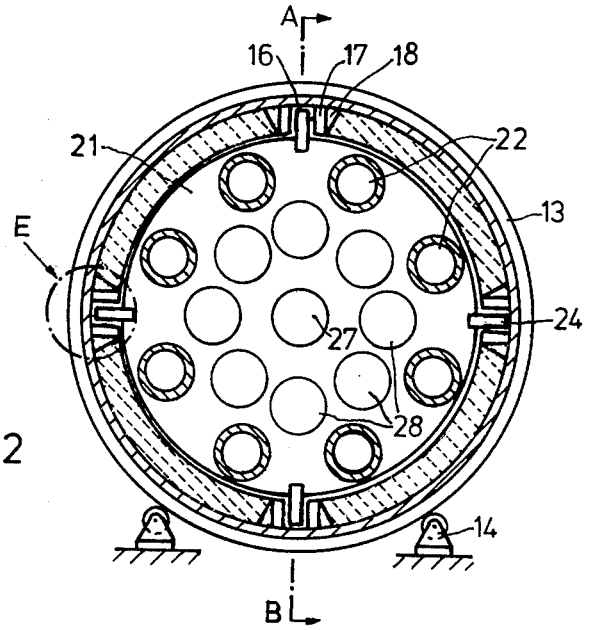
FIG. 2 shows a section through the rotary tube along line C—D in FIG. 1.

Referring to FIGS. 1 and 2, the actual rotary tube 1 consists of an outer casing 3 provided with a refractory lining 2 and of an insert 4 held therein. A burner lance 6 and a material feed tube 7 are guided through a rigidly mounted head piece 5. An additional head piece 8 which can be moved in the axial direction of the rotary tube 1 is arranged at the other end of the rotary tube 1. It is provided with rollers 10 running on rails 9 and has a material outlet opening 11 in the lower part and gas outlet opening 12 in the upper part.

Figure 3:
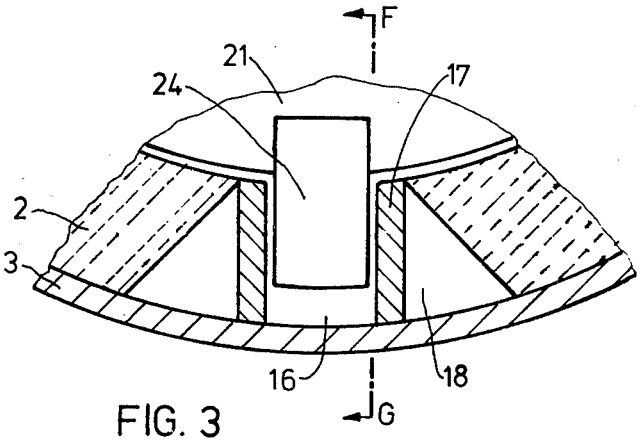
FIG. 3 shows an enlarged view of a detail E from FIG. 2.

The outer casing 3 is provided with ball races 13 resting on roller bearings 14. The drive which is effected by means of a toothed wheel and pinion or directly driven rollers is not shown. The outer casing 3 has an annular groove 15 toward the head piece 5. Moreover, four sliding grooves 16 which are formed by strong metal sheets 17 welded on the outer casing are distributed over the periphery at specific intervals in the longitudinal direction. The metal sheets 17 are further secured by supports 18 (FIG. 3).

Figure 4:
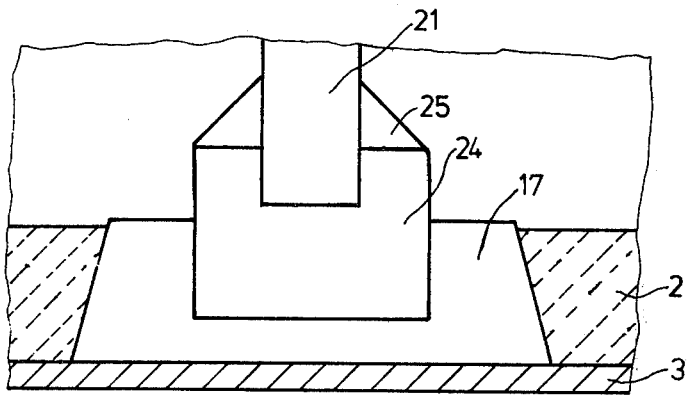
FIG. 4 shows a section through the detail E along line F—G in FIG. 3.

The insert 4 consists of a fixed end plate 19 whose rim engages in the annular groove 15, as well as of an additional end plate 20, the intermediate plates 21 (only one of which is shown) and the treatment tubes 22 mounted in the plates 19, 20, 21. The end plate 19 has a charging ring 23 on its exterior into which the material feed tube 7 merges. The depth of the annular groove 15 is adapted to the diameter of the end plate 19 when it is at its largest under the influence of heat, so that a gap still remains. The width of the annular groove 15 is slightly larger than the thickness of the edge of the engaging end plate 19 so that the end plate 19 can rotate freely during rotation of the insert 4 but is held sufficiently securely in position as viewed in the longitudinal direction. The plates 20, 21 have welded cogs designed as sliding blocks 24, which are reinforced by props 25 (FIG. 4). The sliding blocks 24 engage in the sliding grooves 16. Their depth and width is adapted to the greatest anticipated thermal expansion of the plates 20, 21 or the sliding blocks 24 in order to ensure a sliding motion even in extreme cases. The end plate 19 has opening 26 for filling the treatment tubes 22 as well as a central opening 27 through which the burner lance 6 penetrates. The plates 20, 21 are provided with openings 28 for the passage of the gases.

What we claim is:

1. A rotary heating tube comprising: a rotatable outer casing; at least one treatment tube extending longitudinally in the casing spaced apart from the internal surface of the casing; and means supporting the at least one treatment tube in the casing in the spaced apart location comprising a. support plates disposed within the casing each in a plane perpendicular to the longitudinal axis of the casing and through which the at least one treatment tube passes, the support plates including one end plate to which the at least one treatment tube is fixedly connected, b. first means mounting the one end plate for free rotational movement in the casing with sufficient clearance in the radial direction to allow for radial thermal expansion and substantially no clearance in the axial direction and c. second means mounting the remaining support plates for free sliding movement in the axial direction with sufficient clearance in the radial and angular directions to allow for thermal expansion.

2. The tube according to claim 1, wherein the second mounting means comprises at least three radially extending cogs and means forming at least three sliding grooves configured to slidably receive the cogs with said axial and angular clearance and wherein the cogs are alternatively disposed on the plates or on the internal surface of the casing and the grooves are alternatively disposed on the other of the plates and the internal surface of the casing.

3. The tube according to claim 2, wherein the at least one treatment tube is fixedly connected to all of the plates.

4. The tube according to claim 2, wherein the cogs comprise one of runners and sliding blocks.

5. The tube according to claim 2, wherein the means forming the grooves comprises formed metal sheets connected to the inner surface of the outer casing.

* * * * *